United States Patent [19]

Houghland

[11] 4,179,679

[45] Dec. 18, 1979

[54] THERMAL SWITCH

[75] Inventor: Stephen E. Houghland, St. Paul, Minn.

[73] Assignee: Minnesota Mining and Manufacturing Company, St. Paul, Minn.

[21] Appl. No.: 943,691

[22] Filed: Sep. 19, 1978

[51] Int. Cl.[2] ..... H01H 37/76

[52] U.S. Cl. ..... 337/407; 337/408

[58] Field of Search ..... 337/407, 408, 409, 413, 337/416

[56] References Cited

U.S. PATENT DOCUMENTS

| | | | |
|---|---|---|---|
| 2,934,628 | 4/1960 | Massar et al. | 337/409 |
| 2,955,179 | 10/1960 | Milton et al. | 337/408 X |
| 3,820,050 | 6/1974 | Tyler et al. | 337/408 |
| 4,145,654 | 3/1979 | Grimm | 337/407 |

*Primary Examiner*—George Harris

*Attorney, Agent, or Firm*—Cruzan Alexander; Donald M. Sell; Terryl K. Qualey

[57] ABSTRACT

A thermal switch in which a contact spring is formed from a flat strip of metal into a U-shape with inward extensions from the ends of the legs of the U, the outside faces of each of the legs of the U normally resiliently contacting one of a pair of parallel electrical leads. The contact spring is normally supported to contact the electrical leads by a fusible pellet and is resiliently biased by a compression spring to move parallel to the leads to break the contact when the fusible pellet melts.

8 Claims, 5 Drawing Figures

THERMAL SWITCH

FIELD OF THE INVENTION

The present invention relates to a thermal switch having a fusible pellet which melts and causes the electrical circuit to be disconnected.

BACKGROUND OF THE INVENTION

The prior art is replete with thermal switches in which a contact is normally supported by a fusible pellet to make contact between electrical leads and is biased by a compression spring to break the electrical contact upon melting of the fusible pellet. Such switches are, for example, disclosed in U.S. Pat. Nos. 3,180,958; 3,281,559; 3,291,945; 3,519,972; 3,820,050; 3,956,725; and 4,068,204. In the thermal switches of U.S. Pat. Nos. 3,291,945; 3,820,050; and 3,956,725 the contact element contacts both electrical leads to complete the circuit between them.

SUMMARY OF THE INVENTION

The present invention provides a thermal switch comprising a thin rectangular housing providing a thin rectangular cavity with a pair of spaced parallel electrical leads extending into the cavity through one end wall of the housing. A contact spring formed from a flat strip of metal into a U-shape with inward extensions from the ends of the legs of the U is positioned in the cavity with the outside face of each of the legs normally resiliently contacting one of the leads spaced from the end thereof to electrically connect the leads through the contact spring. The inward extensions of the contact spring with the side walls and the one end wall of the housing define a compression spring pocket. The contact spring is movable in the cavity away from the one end wall of the housing to move the legs thereof out of contact with the leads. A fusible pellet is positioned in the cavity at the end of the housing opposite the one end wall, the pellet extending between the opposite end and the base of the U of the contact spring to support the contact spring in its normal position with the legs thereof contacting the electrical leads. A compression spring, positioned in a pocket defined by the inward extensions of the contact spring and the side walls and the one end wall of the housing, urges the contact spring against the fusible pellet.

The thermal switch of the present invention provides a simple, compact and inexpensive thermal switch. The normal contact of the legs of the contact spring spaced from the end of the electrical leads permit some movement of the contact spring without breaking the electrical circuit which is desirable since deformation and sublimation of the fusible pellet at temperatures well below the melting point of the pellet may permit the compression spring to move the contact spring.

THE DRAWING

Figure 1:
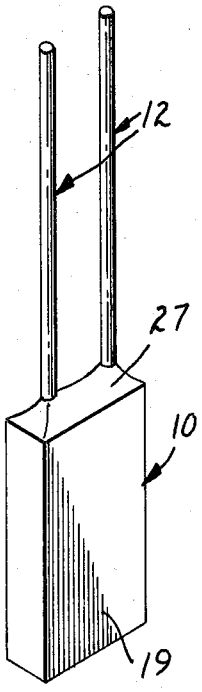
FIG. 1 is a perspective view showing one side, one edge and the top of a thermal switch constructed in accordance with the present invention.

The thermal switch of the present invention comprises a thin rectangular housing 10, a pair of electrical leads 12, a contact spring 14, a fusible pellet 15 and a compression spring 16.

The housing 10 provides a thin rectangular cavity 18 and in the illustrated embodiment consists of an open ended rectangular insulating plastic body 19 and a ceramic end cap 20.

The electrical leads 12 are spaced and parallel and extend into the cavity between the ceramic end cap 20 and the plastic body 19. Each lead is formed from round wire and is cold formed at one end to form a flat 22 at the end extending into the cavity 18, a protrusion 23 which is positioned adjacent the end cap 20 so that the protrusions 23 of the two leads 12 face each other, and a flat 25 to fit between the ceramic end cap 20 and the plastic body 19 at the exit from the cavity 18. The ceramic end cap 20 and the leads 12 are held in place by heat staking of the plstic over the end cap 20 and by an epoxy resin 27 which also seals the end of the housing 10. The ceramic end cap thus extends between the leads 12 at their exit from the cavity 18 and engages the flat lead portions 24 at the cavity exit and the protrusions 23 to prevent the leads 12 from being twisted or from being pulled from or pushed into the cavity 18.

Figure 2:
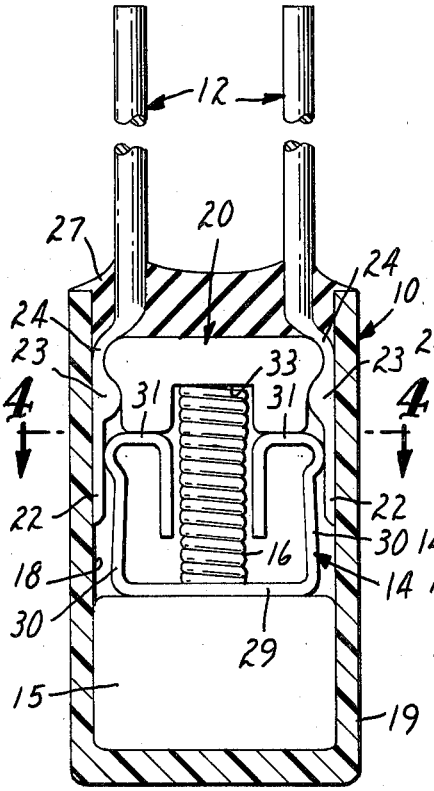
FIG. 2 is a side view of the thermal switch with one side wall removed and with the parts in their normal position.

The contact spring 14 is formed from a flat strip of metal, for example beryllium copper, and has a U-shape with inward extensions from the ends of the legs of the U. The base 29 of the spring contact 14 is normally supported by the fusible pellet 15 as illustrated in FIG. 2 with the outside face of each of the legs 30 of the U normally resiliently contacting one of the leads 12 spaced from the end thereof to electrically connect the leads through the contact spring 14. The contact spring 14 is movable in the cavity 18 parallel to the leads away from the ceramic end cap 20 to move the legs thereof out of contact with the leads to interrupt the electrical circuit. The inward extensions 31 of the contact spring 14 extend toward each other and then parallel to the leads to define a pocket for the compression spring 16 with the side walls of the housing 10 and the end cap 20. The end cap 20 is formed with a central recess 33 at its engagement with the compression spring 16 to prevent lateral movement of the compression spring 16. In assembling the switch, the end cap 20 and leads 12 are inserted into the cavity 18 together until the end cap contacts the inward extensions 31 of the contact spring 14. This precisely defines the pocket for the compression spring 16 and thus permits precise design of the compression spring 16 and the pocket to optimize the loading of the compression spring 16 so as to use the smallest space possible while having adequate spring force to separate the contact spring 14 from the leads 12 when the pellet 15 melts.

Figure 3:
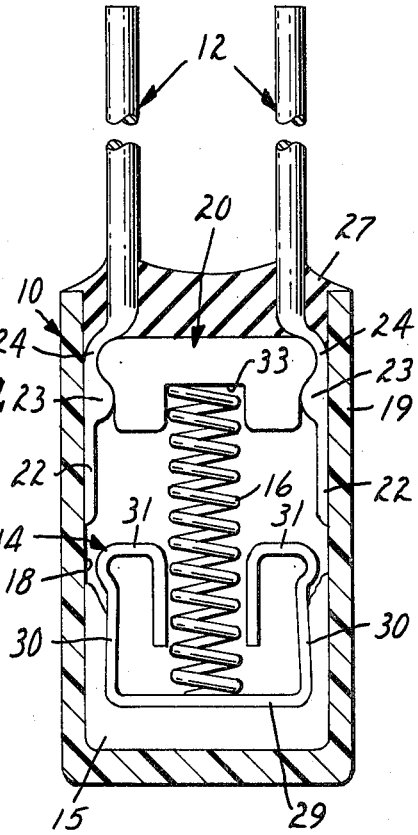
FIG. 3 is a view similar to FIG. 2 with the parts in their positions after the fusible pellet has melted.
Figure 4:
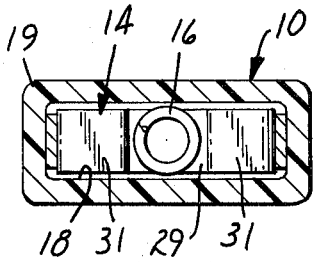
FIG. 4 is a cross sectional view taken generally along line 4—4 of FIG. 2.
Figure 5:
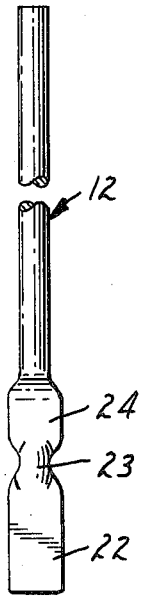
FIG. 5 is a side view of one of the electrical leads.

In use, the leads 12 are connected in an electrical circuit, typically in a device subject to over-temperature conditions if a malfunction occurs. The pellet 15 is chosen to melt at a temperature corresponding to a dangerous over-temperature condition. The circuit is completed so long as the melting temperature of the pellet 15 is not exceeded. Even though some deformation and sublimation of the pellet 15 occurs and the compression spring 16 moves the contact spring 14, electrical contact is maintained between the leads 12 through the contact spring 14 which simply slides down the area of contact on the leads. However, when the fusible pellet melts as illustrated in FIG. 3, the compression spring 16 moves the contact spring 14 parallel to the leads down the housing cavity 18 out of contact from the leads 12 to interrupt the electrical circuit.

Since the current passes through the contact spring 14 from one electrical lead to the other, by proper choice of the material of the contact spring 14 the thermal switch of the present invention can also be made current sensitive. That is, the resistivity of the contact spring material can be chosen so that upon drawing a certain current through the contact spring 14 it heats up sufficiently to melt the fusible pellet 15 to interrupt the circuit.

I claim:

1. A thermal switch comprising:

a thin rectangular housing providing a thin rectangular cavity, a pair of spaced parallel electrical leads extending into said cavity through one end of said housing, a contact spring formed from a flat strip of metal, said contact spring having a U shape with inward extensions from the ends of legs of the U, the outside face of each of the legs of the U normally resiliently contacting one of said leads spaced from the end thereof to electrically connect said leads through said contact spring, said contact spring being movable in said cavity away from said one end of said housing to move the legs thereof out of contact with said leads, said inward extensions of said contact spring defining with the side walls and said one end of said housing a compression spring pocket, a fusible pellet in said cavity at the end of said housing opposite said one end, said pellet extending between said opposite end and the base of the U of said contact spring to support said contact spring in its normal position with the legs thereof contacting said leads, and a compression spring in said pocket urging said contact spring against said pellet.

2. The thermal switch of claim 1 wherein said one end of said cavity is defined by a ceramic end cap.

3. The thermal switch of claim 2 wherein said ceramic end cap is recessed centrally at its contact with said compression spring to prevent lateral movement of said compression spring.

4. The thermal switch of claim 3 wherein said ceramic end cap normally contacts said inward extensions of said contact spring.

5. The thermal switch of claim 1 wherein said electrical leads are flat along their area of contact by said contact spring, are formed with facing protrusions adjacent the end of said cavity and are flat at their exit from said cavity, and an electrically insulating housing end cap extends between said leads at their exit from said cavity and engages said flat lead portions at the cavity exit and said protrusions to prevent said leads from being twisted or from being pulled from or pushed into said cavity .

6. The thermal switch of claim 5 wherein said end cap is ceramic and defines said one end of said cavity.

7. The thermal switch of claim 6 wherein said ceramic end cap is recessed centrally at its contact with said compression spring to prevent lateral movement of said compression spring.

8. The thermal switch of claim 6 or 7 wherein said ceramic end cap normally contacts said inward extensions of said contact spring.

* * * * *